US009021931B1

(12) United States Patent
Zaun

(10) Patent No.: US 9,021,931 B1
(45) Date of Patent: May 5, 2015

(54) METHOD AND APPARATUS FOR THE DELABORATION OF AMMUNITION

(71) Applicant: Horst Zaun, Kollmar (DE)

(72) Inventor: Horst Zaun, Kollmar (DE)

( * ) Notice: Subject to any disclaimer, the term of this patent is extended or adjusted under 35 U.S.C. 154(b) by 4 days.

(21) Appl. No.: 14/083,158

(22) Filed: Nov. 18, 2013

(51) Int. Cl.
*F42B 33/06* (2006.01)

(52) U.S. Cl.
CPC ..... *F42B 33/06* (2013.01)

(58) Field of Classification Search
USPC ..... 86/49–50
See application file for complete search history.

(56) References Cited

U.S. PATENT DOCUMENTS

| | | | | |
|---|---|---|---|---|
| 5,974,937 | A * | 11/1999 | Doughty et al. | 86/49 |
| 6,110,308 | A * | 8/2000 | Ewald et al. | 149/109.6 |
| 6,901,835 | B1 * | 6/2005 | Chamlee | 86/49 |
| 2005/0109199 | A1 * | 5/2005 | Chamlee | 86/49 |
| 2010/0147177 | A1 * | 6/2010 | Van Stratum | 102/470 |

FOREIGN PATENT DOCUMENTS

| | | | |
|---|---|---|---|
| DE | 19736298 | A1 | 2/1999 |
| DE | 20215938 | U1 | 3/2003 |
| DE | 10251105 | A1 | 5/2004 |

* cited by examiner

*Primary Examiner* — Michael David
(74) *Attorney, Agent, or Firm* — Lempia Summerfield Katz

(57) ABSTRACT

The invention relates to a method and apparatus for the delaboration of ammunition, in particular shells having a housing with a tubular housing portion made of steel and open at one end, a cone made of ductile metal and fitted into the tubular housing portion, the cone having a base with a tubular rim, and an explosive charge contained between the housing and the cone. The method comprises a) inserting an extraction tool through the open end into the tubular housing portion for extracting the cone, b) axially compressing the tubular rim of the cone between the extraction tool and the explosive charge, c) deforming a portion of the tubular rim into a form fit with the extraction tool, d) withdrawing the extraction tool from the housing portion, and e) at least partially withdrawing the cone from the housing portion together with the extraction tool.

21 Claims, 7 Drawing Sheets

METHOD AND APPARATUS FOR THE DELABORATION OF AMMUNITION

BACKGROUND

1. Field of the disclosure

The present invention relates to a method and apparatus for the delaboration of ammunition, in particular for delaborating shells originating from cluster bombs or cluster rockets.

2. Discussion of Prior Art

DE 197 36 298 A1 of the present applicant discloses a method and an apparatus for the delaboration of a shell with a steel housing that contains an explosive charge and a cone made from copper or a copper alloy. The steel housing consists of a tubular housing portion that adjoins an open end and a tapered housing portion that adjoins a closed end. The closed end of the tapered housing portion has three bores. Two of the bores are for fastening a detonator and parachute unit to the outer surface of the closed end. The bore in the middle serves for igniting the explosive charge. The cone is fitted into the housing so that the tip of the cone faces towards the detonator and is located in a distance from the closed end, whereas the base of the cone faces towards the open end. In order to fasten the cone securely within the housing to keep it in place even under high acceleration forces the base of the cone is provided with a short unitary tubular rim which is partially expanded during the assembly of the shell into a form fit with an inner circumferential groove provided on the inside of the tubular housing portion. The explosive charge consists of compacted RDX within the steel housing and located between the cone and the closed end. Upon ignition of the explosive charge the cone will direct a jet of hot gas and copper vapor through the open end.

Some armies possess large quantities of such shells. Due to the fact that cluster bombs or cluster rockets have been banned this ammunition has to be delaborated. A fast, reliable and non-expensive method for dismantling such shells is disclosed in DE 197 36 298 A1.

This method comprises: removing the parachute and detonator unit, locating the ammunition in an upright position on a support for alignment with a compression punch, the open end of the tubular housing portion facing upwardly, then moving the compression punch downwardly and axially compressing the tubular housing portion. When the pressure is high enough a length of the tubular housing portion will bulge outwardly adjacent to the circumferential groove. The tubular rim of the cone will not bulge together with the tubular housing portion so that it is released from the form fit with the groove. Then the cone can be withdrawn through the open end of the tubular housing portion and thereafter the explosive charge be removed. A disadvantage of the method and apparatus according to DE 197 36 298 A1 is that very high pressures are needed to deform the tubular housing portion of the shell in order to disengage the cone from the groove in the housing portion.

In addition to the type of shell mentioned above there is a further type of shell where the tubular housing portion is provided with an inner cylindrical aluminum liner or insert in order to avoid the need for milling a circumferential groove into the hard steel of the shell and thereby to facilitate its production. In this type of shell the circumferential groove is provided in the inner wall surface of the aluminum liner. An example of this type of shell is disclosed in DE 202 15 938 U1 of the applicant together with two different apparatuses and methods for delaborating or dismantling such a shell.

The apparatus of FIGS. 1a to 1d of DE 202 15 938 U1 comprises an extraction tool and a punch for pressing the extraction tool into the housing portion. The extraction tool comprises an annular blade delimited by a cylindrical outer surface and a conical inner surface and having a sharp blade edge at the intersection of the outer and inner surface. The cylindrical outer surface of the blade has a diameter that is equal to the inner diameter of the aluminum liner. The conical inner surface of the blade is steeply inclined and intersects the vertical axis of movement of the extraction tool at an inclination of less than 30 degrees. Inwardly from the conical inner surface the extraction tool is provided with a circumferential groove which is delimited by the conical inner surface of the annular blade and by an opposing conical surface having the same angle of inclination. In order to remove the cone from the tubular housing portion of the shell the extraction tool is moved into the tubular housing portion of the shell. When the sharp edge of the annular blade reaches the top end of the tubular rim of the cone it is forced by the punch between the aluminum liner and the rim. This will deflect the tubular rim inwardly so that it will enter the circumferential groove. Upon further downward movement of the extraction tool the movement of the tubular rim into the groove of the extraction tool will disengage the outer rim portion from the groove of the aluminum liner. When the extraction tool reaches the position in FIG. 1(b) the cone has been completely separated from the form fit with the aluminum liner and will only adhere to the explosive charge. In order to expose the explosive charge the punch is moved upwardly thereby withdrawing the cone from the shell. In order to remove the cone from the extraction tool the latter comprises an inner bore and an ejecting tool within the inner bore. The ejecting tool is axially movable relative to the extraction tool in order to push the cone downwardly out of engagement with the extraction tool after the cone has been withdrawn from the tubular housing portion of the shell, as can be seen in FIG. 1(d).

However this type of extraction tool is only suitable for dismantling shells having an aluminum liner. This is due to the fact that the sharp edge of the annular blade tends to break when it comes into contact with the inner surface of a tubular housing section made of steel.

SUMMARY

The present disclosure relates to a method and apparatus for the delaboration of ammunition, in particular for delaborating shells originating from cluster bombs or cluster rockets and having a steel housing that contains an explosive charge and a ductile metal cone. More particularly the disclosure relates to a method and apparatus for dismantling ammunition having a housing with a tubular housing portion made of steel and being open at one end, a cone made of ductile metal and fitted into the tubular housing portion, the cone having a base with a short tubular rim, and an explosive charge contained between the housing and the metal cone.

In view of the foregoing, it is an aim of the present disclosure to provide a method and apparatus which are suitable to remove the metal cone from shells or other ammunition without any aluminum liner and to considerably reduce the pressure needed to disengage the cone from the groove in the housing portion.

In order to achieve this aim the method according to the present disclosure comprises the following steps: a) inserting an extraction tool through the open end into the tubular housing portion for extracting the cone through the open end, b) axially compressing the tubular rim of the cone between the extraction tool and the explosive charge, c) deforming a portion of the tubular rim into a form fit with the extraction tool, d) withdrawing the extraction tool from the housing portion, and e) at least partially withdrawing the cone from the housing portion together with the extraction tool.

In contrast to the method of DE 202 15 938 U1 the tubular rim of the cone is axially compressed between the extraction tool and the explosive charge that acts as an abutment in order to deform a portion of the rim inwardly into a form fit engagement with the extraction tool.

The apparatus according to the disclosure comprises at least one seat for receiving the ammunition and for holding the ammunition in a position, where the open end of the housing portion faces away from the seat; an extraction tool; means for pressing the extraction tool into the tubular housing portion, wherein the extraction tool comprises a blunt annular compression face for engagement with an end face of the tubular rim of the cone and further comprises a circumferential groove for receiving a portion of the compressed and deformed tubular rim in a form fit engagement.

According to a preferred embodiment of the method steps a) to e) are performed after a preceding step of removing a detonator from the ammunition.

Preferably step b) comprises compressing an upper end portion of the tubular rim of the cone between the blunt annular compression face of the extraction tool and the explosive charge by a compressive force exerted to the extraction tool in order to deform the ductile metal of the rim's upper end portion radially inwardly into the form fit with the circumferential groove of the extraction tool.

In order to make sure that the annular face of the extraction tool will exactly hit the rim's upper end portion and will not make contact with an end face surrounding the open end of the tubular housing portion when the extraction tool is moved into the open end according to a further preferred embodiment of the disclosure the method comprises the step of aligning the tubular housing portion and the extraction tool with respect to each other, preferably by engaging the tubular housing portion with a complementary recess of an alignment tool surrounding the extraction tool and being movable into engagement with the tubular housing portion before the extraction tool is moved into the open end.

In order to prevent the tubular rim of the cone from yielding anywhere else than into the circumferential groove of the extraction tool advantageously a lower portion of the tubular rim that is located between the upper end portion or the rim an a conical portion of the cone is constrained, preferably in a narrow gap between an annular protrusion or ledge of the extraction tool and the inner surface of the tubular housing portion. Preferably the gap has a width approximately equal to the thickness of the tubular rim of the cone.

The amount of deformation and expansion of the ductile metal of the rim's upper end portion into the circumferential groove of the extraction tool is preferably such that the forces required to remove the rim's deformed upper end portion from the form fit with the circumferential groove exceed the frictional forces required to withdraw the metal cone from the tubular housing portion of the shell.

According to another preferred embodiment of the method step b) comprises shearing off an external portion of the tubular rim of the metal cone which external portion is in engagement with an inner circumferential groove of the tubular housing portion. This is to eliminate the form fit of the cone's tubular rim with the inner circumferential groove of the tubular housing portion before starting to withdraw the metal cone from the tubular housing portion.

After having deformed the tubular rim of the cone and after having sheared it off from the tubular housing portion the extraction tool is withdrawn from the tubular housing portion together with at least a portion of the cone.

After these steps the metal cone is separated or removed from the extraction tool. This is preferably achieved by moving the extraction tool upwardly during the step of withdrawing the extraction tool from the tubular housing and eliminating the form fit of the deformed upper end of the tubular rim with the extraction tool and by pushing the metal cone downwardly from above.

Preferably the metal cone is removed from the extraction tool while a tip of the metal cone is still within the tubular housing portion so that the metal cone will partially fall back into tubular housing portion after removal from the extraction tool. In this way it is possible to burn any explosive adhering to the cone together with the explosive within the housing in a succeeding method step.

However it is also possible to remove the metal cone from the extraction tool in a distance above the tubular housing portion and then take off the cone and the rest of the shell separately for delaborating the explosive.

The apparatus according to the disclosure preferably comprises an alignment tool for aligning the tubular housing portion and the extraction tool with respect to each other. Advantageously the alignment tool surrounds the extraction tool, is movable with respect to the extraction tool and has a recess which faces the tubular housing portion that is received in the seat. In this way the alignment tool can be moved into engagement with the tubular housing portion to align or center the tubular housing portion latter with respect to the extraction tool before the extraction tool is moved into the open end of the tubular housing portion. Advantageously an upper end portion of the recess has an inner diameter which corresponds to an outer diameter of the tubular housing portion whereas a lower end portion of the recess is tapered or flared downwardly and outwardly in order to facilitate the entry of the tubular housing portion into the recess.

According to another preferred embodiment of the disclosure the blunt annular compression face of the extraction tool has an outer diameter which is only slightly less than an inner diameter of the tubular housing portion. The outer end of the blunt annular compression face is advantageously a sharp edge which will assist in the shearing off of the external portion of the tubular rim within the inner circumferential groove of the tubular housing portion from the rest of the tubular rim.

According to another preferred embodiment of the disclosure the blunt annular compression face of the extraction tool is recessed upwardly with respect to a lower end face of the extraction tool so that the tubular rim of the cone can be constrained between the blunt annular compression face and the lower end face of the extraction tool in order to prevent the rim from yielding or bulging radially inwardly anywhere else than into the circumferential groove of the extraction tool.

Preferably an upper end wall of the circumferential groove of the extraction tool merges into the blunt annular compression face and advantageously has the same inclination with respect to the axis of movement of the extraction tool. In this way the upper end portion of the cone's tubular rim will be more easily deformed into the groove during its compression.

Advantageously an angle of inclination of the blunt annular compression face with respect to the axis of movement of the extraction tool exceeds 60 degrees, more advantageously 75 degrees and can be up to 90 degrees.

In order to eliminate the form fit engagement of the deformed upper end portion of the metal cone's rim with the extraction tool after having withdrawn the extraction tool from the tubular housing portion according to a further preferred embodiment of the disclosure the apparatus comprises an ejecting tool within an inner axial bore of the tubular extraction tool wherein the ejecting tool and the extraction tool are axially movable relative to each other. The ejecting tool can be stationary or can be movable with respect to the extraction tool.

BRIEF DESCRIPTION OF THE DRAWINGS

Objects, features and advantages of the present invention will become apparent upon reading the following description in conjunction with the drawing figures, in which.

DETAILED DESCRIPTION OF THE DISCLOSURE

Figure 1:
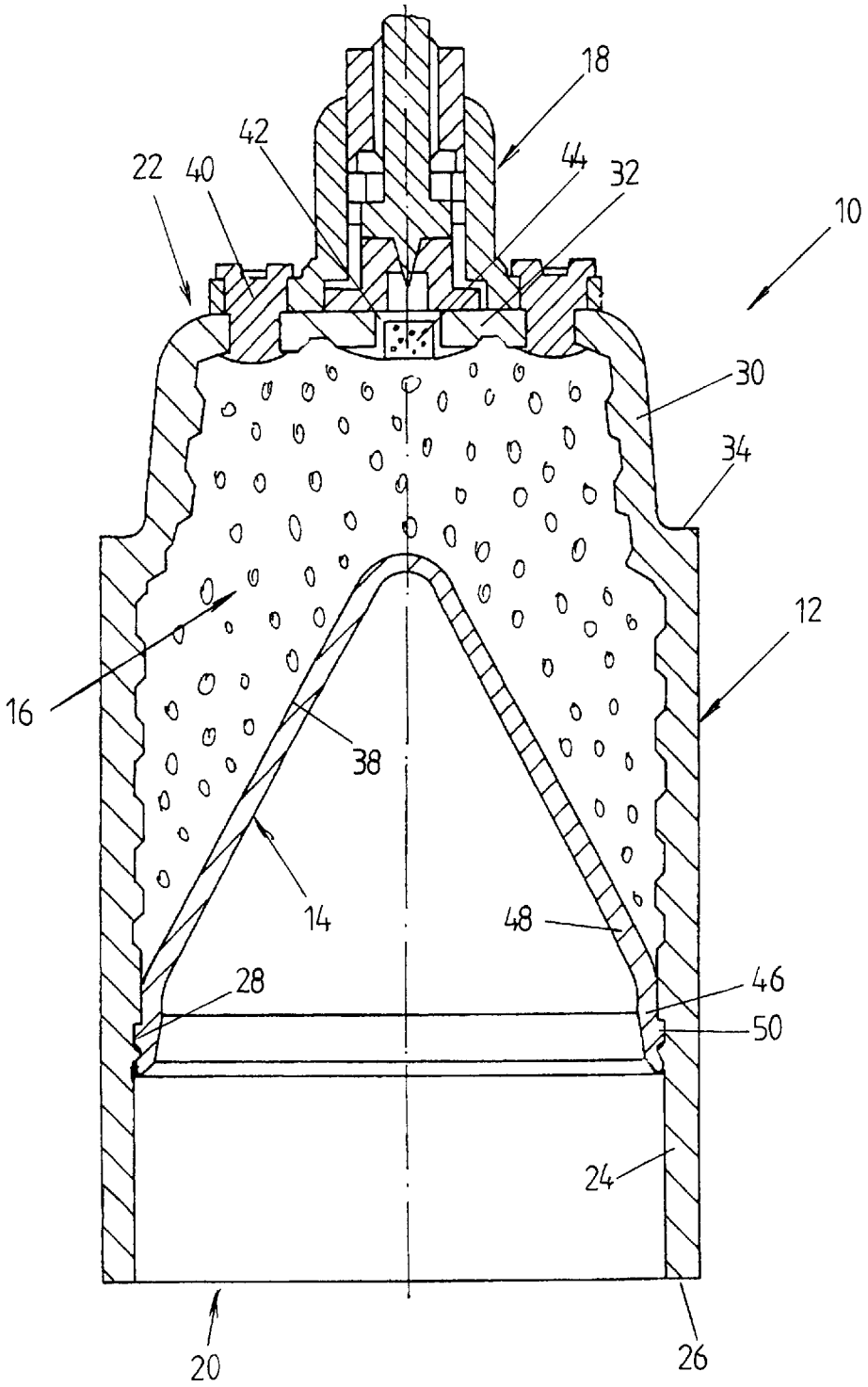
FIG. 1 is a sectional view of ammunition to be delaborated.

The apparatus depicted in the drawings is part of a plant for delaborating ammunition. The ammunition to be delaborated consists of shells 10 which are housed in cluster bombs or cluster rockets and are used especially for fighting tanks and other armored targets. An example of such a shell 10 is depicted in FIG. 1 of the drawing.

The shell 10 depicted in FIG. 1 comprises a body or housing 12, a metal cone 14 and an explosive charge 16 within the housing 12 and a detonator 18 outside the housing 12.

The one piece housing 12 has an open end 20 and a closed end 22 and is made of steel. The housing 12 comprises a first tubular housing portion 24 adjoining the open end 20. The tubular housing portion 24 has a plane end face 26 surrounding the open end 20 and is provided with an inner circumferential groove 28 in a distance from the open end 20 or end face 26. The housing 12 comprises a second tapered housing portion 30 adjoining the closed end 22 and comprising an end wall 32. Between the first and second housing portion 24, 30 there is a circumferential step or shoulder 34 that is parallel to the end face 26. The end wall 32 of the second housing portion 30 has two outer bores each housing a rivet 40 for fastening the detonator 18 to the end wall 32 and a central bore 42 holding a part 44 of a detonator charge, which is used for igniting the explosive charge 16.

The explosive charge 16 is located in a part of the housing 12 that is adjacent to the closed end 22. The explosive charge 16 consists of compacted RDX powder and is in contact with the detonator charge 44. The compaction of the RDX powder during the assembly of the shell 10 is performed with a conical tool having a rounded tip such that the compacted RDX has a conical depression 38 facing the open end.

The metal cone 14 is made of copper or a copper alloy. The cone 14 is fitted into the housing 12 in such a way that a rounded tip of the cone 14 faces towards the detonator 18 and a base of the cone 14 faces towards the open end 20. The tip is located in a distance from the end wall 32 and the base is located in a distance from the open end 20. The cone 14 comprises a conical portion 48 between the base and the tip. The shape of the conical portion 48 corresponds to the shape of the depression 38. At the base the cone 14 comprises a short tubular rim 46. During the assembly of the shell 10 the conical portion 48 of the prefabricated cone 14 is pressed into the depression 38 and then the ductile tubular rim 46 is partially expanded radially outwardly in order to achieve a form fit engagement of an external portion 50 of the rim 46 within the inner groove 28 of the tubular housing portion 24 in order to fasten the cone 14 to the housing 12.

A large number of such shells 10 are arranged within a cluster bomb or cluster rocket (not shown). The cluster bomb or cluster rocket is activated in the air above the target. Upon activation the shells 10 are ejected from the bomb or rocket. Upon ejection from the bomb or rocket a parachute (not shown) attached to the detonator 18 will open. The shell suspended from the parachute will fall down and hit the target from above. When the shell 10 hits the target the detonator 18 will ignite the detonator charge 44 which in turn will ignite the explosive charge 16. Upon ignition of the explosive charge 16 the cone 14 will direct a jet of hot gas and copper vapor through the open end 20 in order to penetrate the armor of the target.

Due to the fact that cluster bombs have been banned a large amount of such shells 10 has to be delaborated. In order to avoid any accidents during the delaboration in a first step the detonator 18 is removed from the housing 12. This can be done in the manner described in DE 197 36 298 A1. Reference is made to this description.

After the removal of the detonator 10 the rest of the shell 10 consisting of the steel housing 12, the detonator charge 44, the explosive charge 16 and the metal cone 14 is delaborated by separating and removing the cone 14 from the housing 12 in order to create an access for oxygen from the ambient air to the explosive charge 12 which will permit burning the explosive charge 16 without any risk of explosion.

The separation and removal of the cone 14 from the housing 12 is achieved with the apparatus depicted in the drawings. As can be best seen from FIGS. 2 to 13 the apparatus comprises a support 52 with a through opening 54, a receptacle or holder 56 for the housing 12, the holder 56 being received in the through opening 54, an extraction tool 58, a punch 60 carrying the extraction tool 58, an alignment tool 62 surrounding the extraction tool 58 and an ejection tool 64 within a central bore 66 of the extraction tool 58. The through opening 54, the holder 56, the extraction tool 58, the alignment tool 62 and the ejection tool 64 are all coaxial to a vertical central axis 66 of the apparatus that is aligned with the central axis of the through opening 54, the holder 56, the extraction tool 58, the alignment tool 62 and the ejection tool 64 respectively.

The support 52 and the holder 56 are both arranged in a lower part of the apparatus. The support 52 is provided with a plane upper surface for supporting a downwardly facing shoulder 68 of the holder 56 and receives a lower cylindrical portion of the holder in a form fit within the through opening 54.

The holder 56 is provided with a central through bore 70 for receiving the shell 10 that is depicted in FIGS. 2 to 13 in a somewhat simplified manner. The support 52 and the holder 56 inserted into the bore 70 provide a seat for the shell 10. The shell 10 is inserted into the seat in an orientation where the open end 20 faces upwardly towards the extraction tool 58 and where the closed end 22 faces downwardly through the open bottom end of the bore 70. The bore 70 consists of a lower section and an upper section. The lower section has an inner diameter that corresponds to the maximum outer diameter of the tapered housing portion 30. The upper section has an inner diameter that corresponds to the outer diameter of the tubular housing portion 24. The upper end of the upper section is somewhat tapered or flared upwardly in order to facilitate the insertion of the shell 10 into the bore 70. The upper section and the lower section are separated by an upwardly facing shoulder 72 which is orthogonal to the central axis 66 and supports the shoulder 34 of the housing 12 when the shell is in the seat. The distance of the shoulder 72 from a plane upper surface of the holder is such that the tubular housing portion 24 protrudes upwardly from the bore 70.

The punch 60, the alignment tool 62, the extraction tool 58 and the ejection tool 64 are arranged in an upper part of the apparatus above the seat. The upper end (not shown) of the punch 60 is connected to a ram (not shown) of a hydraulic press. The bottom end of the punch 60 carries the extraction tool 58 that is screwed into a threaded axial bore in the bottom end of the punch 60.

The alignment tool 62 is made of steel and has a tubular shape that is open at its upper end in order to receive the punch 60 and the extraction tool 58. A thick bottom wall 74 of the alignment tool 62 is provided with a central through bore for the extraction tool 58. The bottom end of the bore opens into a recess 76 that is coaxial to the axis 66. The recess 76 has an upper section with an inner diameter that corresponds to the outer diameter of the tubular housing portion 24. A lower end section of the recess 76 is tapered or flared downwardly in order to facilitate the entry of the top end of the tubular housing portion 24 into the recess 76. Between the two sections there is a shoulder 78 that faces downwardly. The width of the shoulder 78 is somewhat less than the width of the upper end face 26 of the tubular housing portion 24 as can be best seen from FIG. 5.

The extraction tool 58 is made of hardened steel and has a tubular shape with a circular cross section. An outer diameter of the extraction tool 58 corresponds to an inner diameter of the tubular housing portion 24 of the shell 10. The upper end of the extraction tool 58 is provided with a thread (not shown). Close to the bottom end the extraction tool is provided with a circumferential groove 80 and a blunt annular compression face 82. The circumferential groove 80 has an opening that faces radially outwardly. The circumferential groove is delimited by an upper side face, a lower side face and an inner end face between the upper and lower side face. The upper side face and the lower side face are orthogonal to the axis 66. The upper side face merges into the annular compression face 82 which is also orthogonal to the axis 66. There is a sharp 90 degree edge 84 between the annular compression face 82 and a cylindrical outer surface of the tubular extraction tool 58.

In another embodiment (not shown) the upper side face and the lower side face of the circumferential groove 80 as well as the blunt compression face 82 may be inclined with respect to the axis 66 radially outwardly and downwardly with an angle of inclination that does not exceed 30 degrees.

The lower side face of the circumferential groove 80 is the upper surface of an annular ledge 86 that protrudes radially outwardly below the circumferential groove 80. The maximum outer diameter of the ledge 86 corresponds to the inner diameter of the tubular rim 46 of the cone 14 as can be best seen from FIG. 7. From the ledge 86 the extraction tool 58 tapers downwardly and inwardly towards a plane end face 88. The inclination of the taper corresponds to the inclination of the conical portion 48 of the cone 14 as can be best seen from FIG. 7.

The ejection tool 64 is a rod that is movable with respect to the extraction tool 58 within a central bore of the tool 58. The solid ejection tool 64 has a plane bottom end and a taper 90 between the plane bottom end and a cylindrical outer surface of the rod. The inclination of the taper 90 corresponds to the inclination of the conical portion 48 of the metal cone 14 as can be best seen from FIG. 11.

Figure 2:
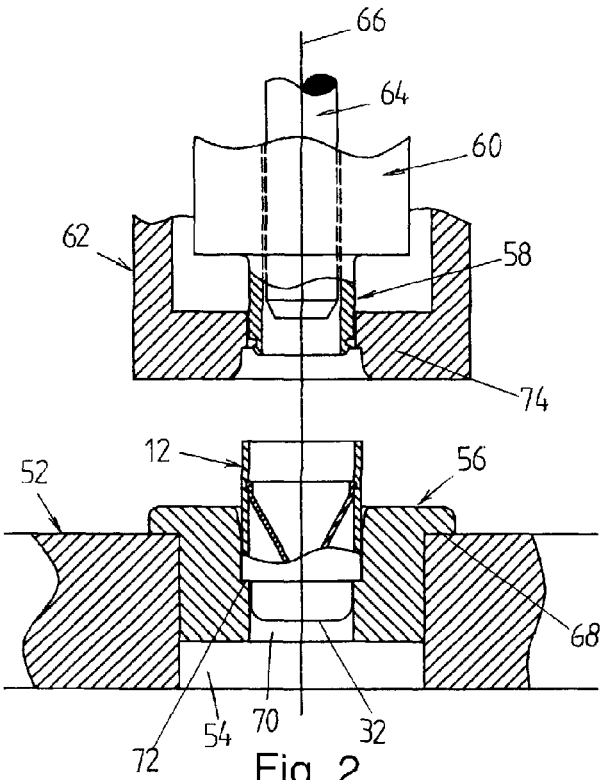
FIG. 2 is a partially cut off view of an apparatus for removing a metal cone from the ammunition in an initial or starting position of a removal process, after having dismantled the detonator.
Figure 3:
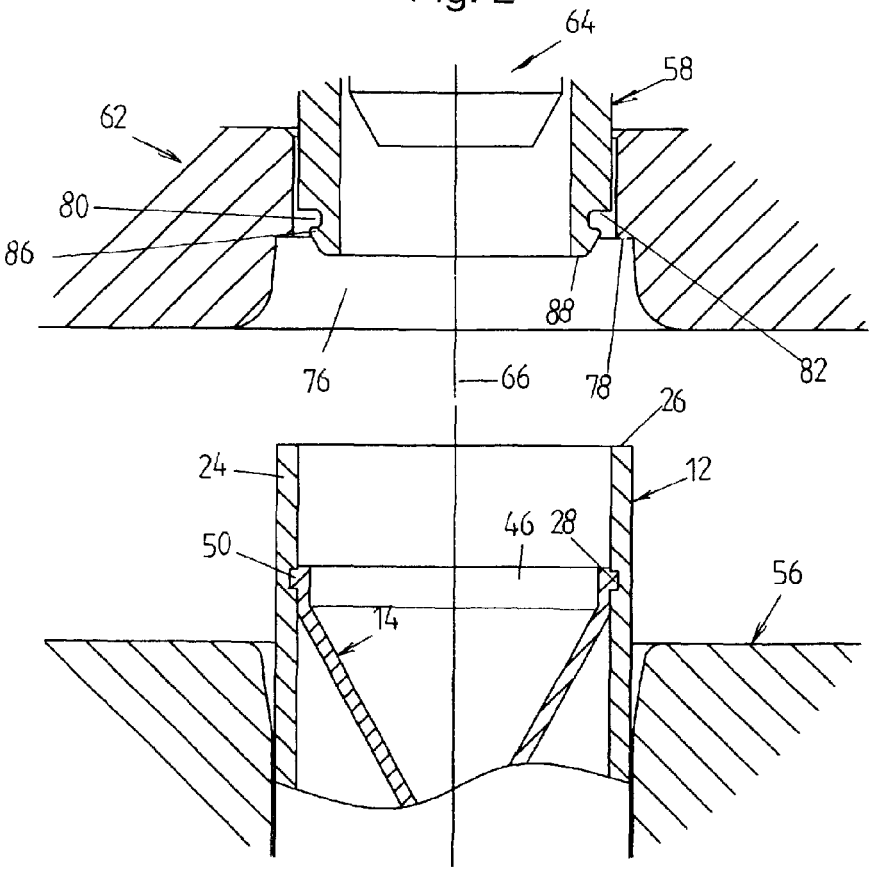
FIG. 3 is an enlarged detailed view of a central portion of FIG. 2.

The function of the apparatus will be explained below: In an initial or starting position of a process for separating and removing the metal cone 14 from the shell 10 the housing 12 is in the seat of the holder 56 and the holder 56 is in the bore 54 of the support 52, as shown in FIGS. 2 and 3. The punch 60 with the extraction tool 58 and the alignment tool 62 are in an upper end position in a distance above the seat. The stationary ejection tool 62 protrudes downwardly from the bore of the extraction tool 58.

Figure 4:
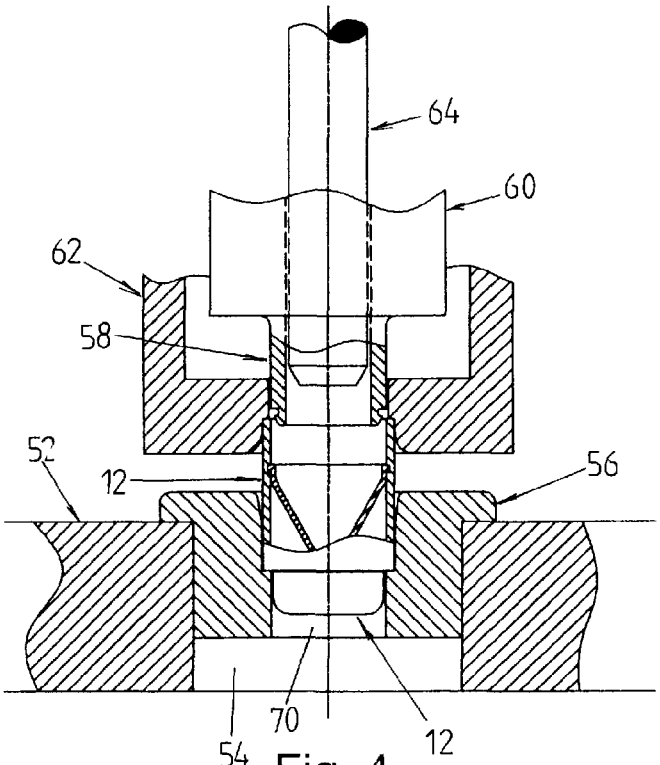
FIG. 4 is a view corresponding to FIG. 2 during a first step of the removal process.
Figure 5:
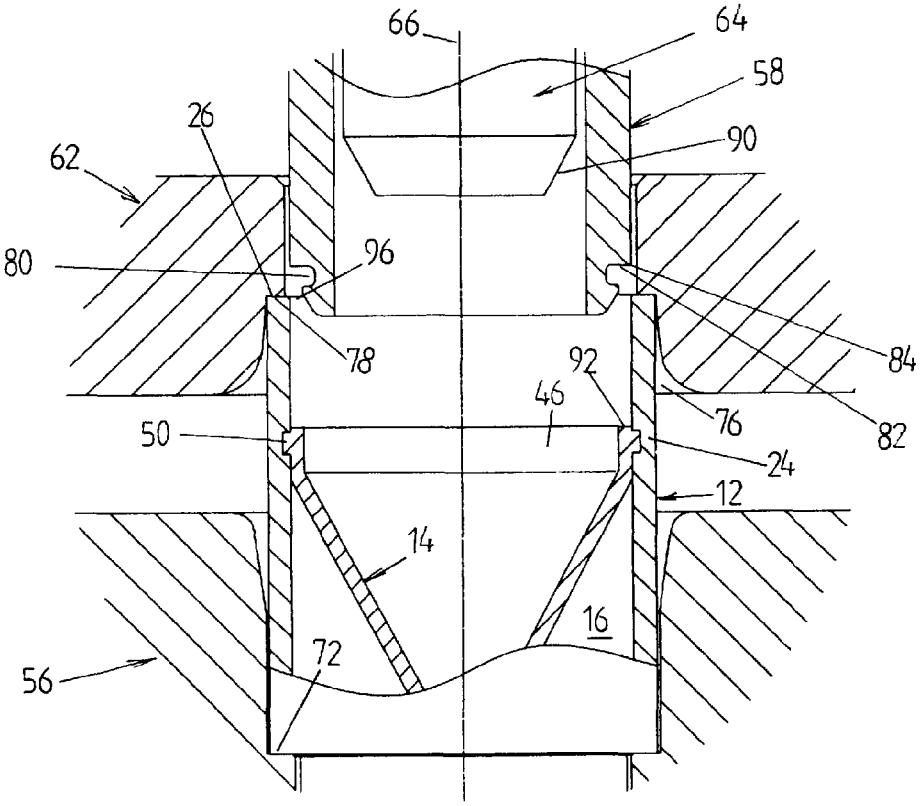
FIG. 5 is an enlarged detailed view of a central portion of FIG. 4.
Figure 6:
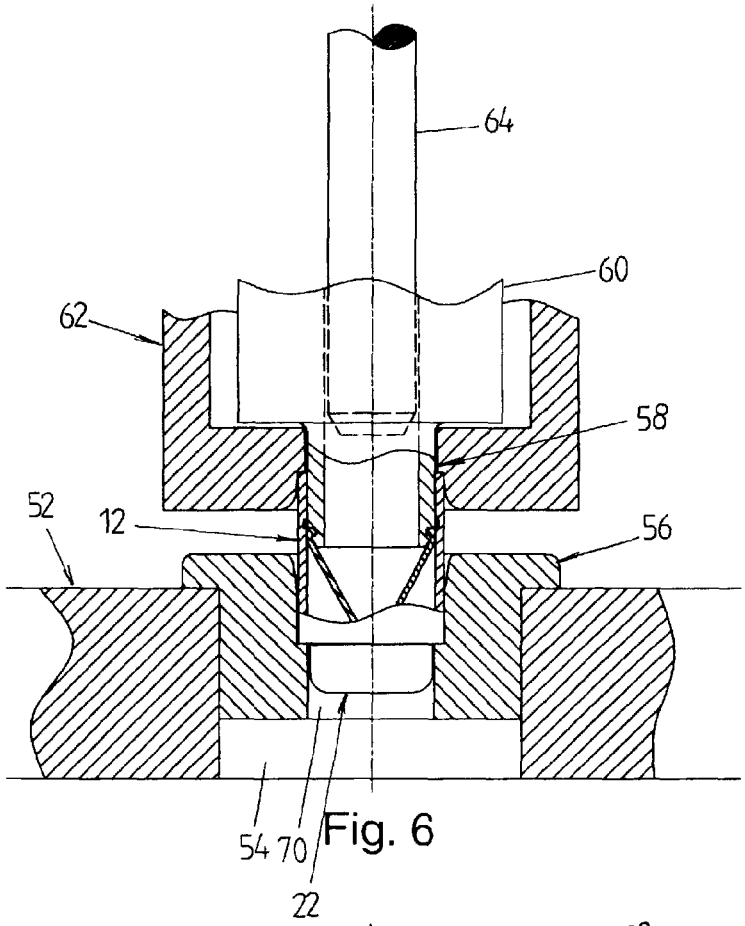
FIG. 6 is a view corresponding to FIGS. 2 and 4 during a second step of the removal process.
Figure 7:
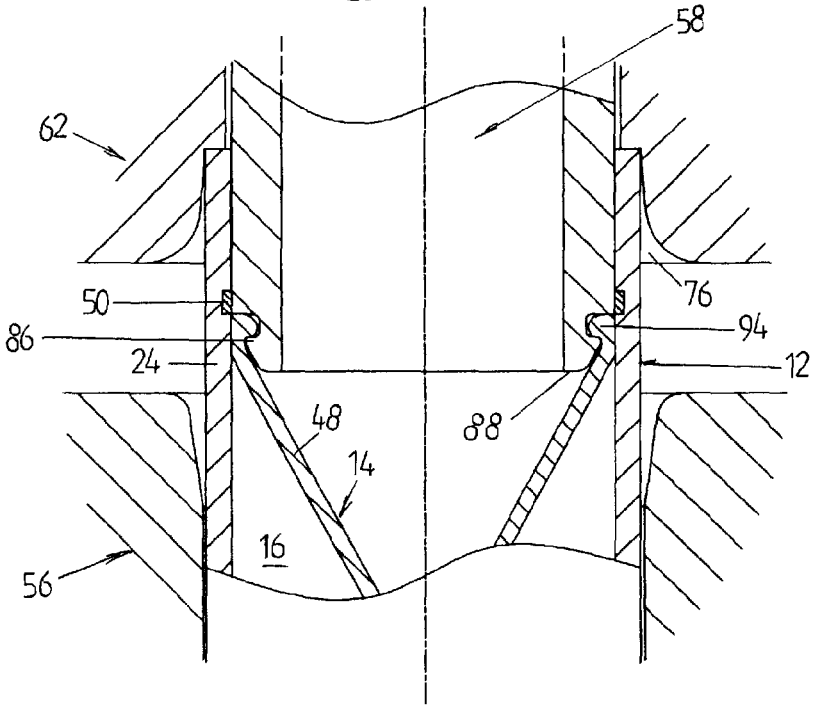
FIG. 7 is an enlarged detailed view of a central portion of FIG. 6.

In a first step of the process, as shown in FIGS. 4 and 5, the alignment tool 62 is moved downwardly with respect to the punch 60, the extraction tool 58 and the ejection tool 64 into a position where the shoulder 78 rests upon the end face 26 of the tubular housing portion 24 and the tubular housing portion 24 is clamped between the alignment tool 62 and the shoulder 72 of the holder 56. As can be best seen from FIG. 5 in this position the alignment tool 62 will align the upper end of the tubular housing portion 24 with respect to the axis 66 of the punch 60, the extraction tool 58 and the ejection tool 64 so that the tubular housing portion 24 will be centered with respect to the axis 66. At the end of the first step the bottom end of the extraction tool 58 protrudes slightly into the upper end of the tubular housing portion 24 however the extraction tool 58 neither contacts the housing portion 24 nor the cone 14. The ejection tool 64 is kept stationary during the first step.

In a second step of the process the punch 60 with the extraction tool 58 is moved downwardly with respect to the alignment tool 62 and the ejection tool 64 into the interior of the tubular housing portion 24. When the blunt compression face 82 passes the level of an upper end face 92 of the tubular rim 46 of the cone 14 an upper end portion 94 of the tubular rim 46 will be compressed and deformed by the axial downward forces of the punch 60 that are exerted from the blunt compression face 82 onto the upper end face 92 of the tubular rim 46, as can be seen from FIGS. 6 and 7. During the compression and the deformation of the upper end portion 94 of the tubular rim 46 some of the ductile metal of the upper end portion 94 will yield into the circumferential groove 80 of the extraction tool 58. By appropriately selecting the length of the stroke of the punch 60 and extraction tool 58, i.e. about 1.8 mm from the contact of the compression face 82 with the end face 92, the compressed and deformed upper end portion 94 will engage with the groove 80 in a form fit. At the same time the external portion 50 of the tubular rim 46 within the groove 28 will be sheared off from the rest of the tubular rim 12 along the inner surface of the tubular housing portion 24 as can be best seen from FIG. 7. In order to prevent the ductile metal of the rim 46 from buckling or yielding anywhere else the rim 46 is constrained below the lower side face of the groove 80 in a gap 96 between the ledge 86 and the inner surface of the tubular housing portion 24 that acts as an abutment for the ductile metal of the rim 46. The lower end of the tubular rim 46 is pressed against the explosive charge 16 that also acts as an abutment preventing the rim 46 from yielding in this direction. At the end of the second step the deformed upper end portion 94 of the rim 46 is in form fit engagement with the groove 80 whereas there is only a frictional fit engagement between the outer peripheral surface of the rim 46 and the opposing inner surface of the tubular housing portion 24. The ejection tool 64 is kept stationary during the second step.

Figure 8:
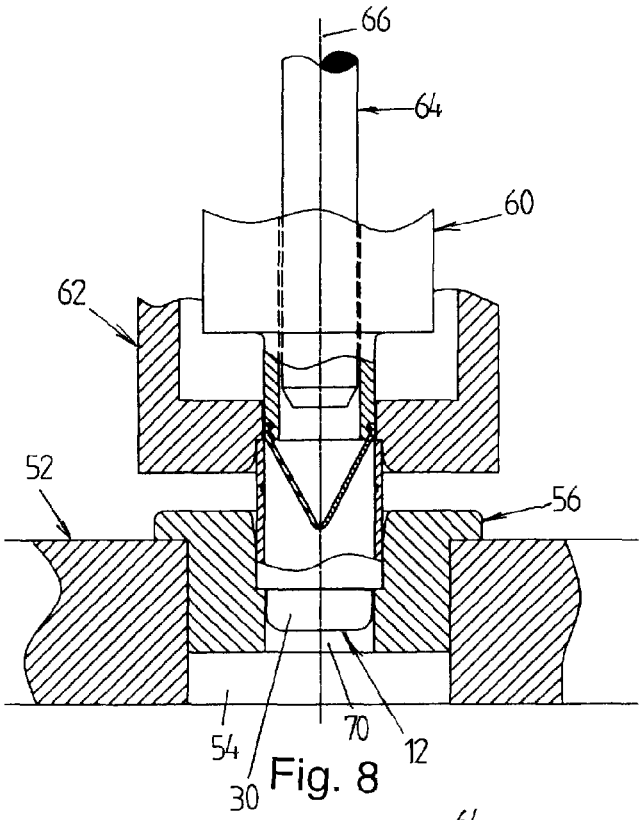
FIG. 8 is a view corresponding to FIGS. 2, 4 and 6 during a third step of the removal process.
Figure 9:
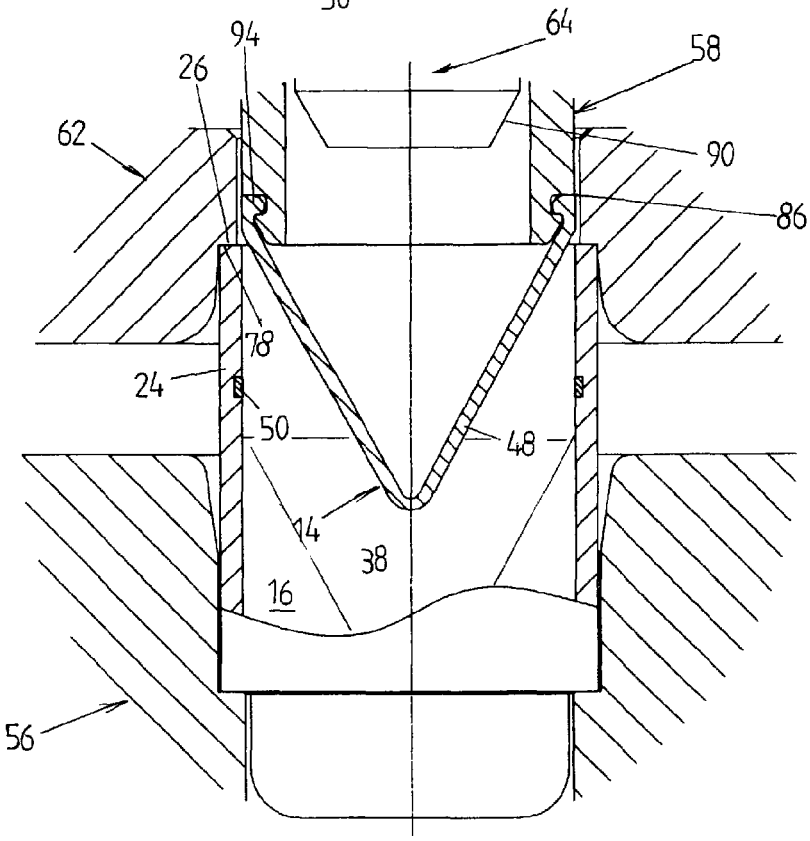
FIG. 9 is an enlarged detailed view of a central portion of FIG. 8.

In a third step of the process as shown in FIGS. 8 and 9 the punch 60 with the extraction tool 58 is moved upwardly with respect to the alignment tool 62 and the ejection tool 64. Due to the fact that the axial forces required to eliminate the form fit engagement of the deformed upper end portion 94 of the rim 46 with the extraction tool 58 exceed the frictional forces required to withdraw the metal cone 14 from the tubular housing portion 24 the metal cone 14 is moved upwardly together with the extraction tool 58 until the tubular rim 46 has left the tubular housing portion 24. The sheared off external portion 50 of the tubular rim 46 will remain within the groove 28. The ejection tool 64 is kept stationary during the third step.

Figure 10:
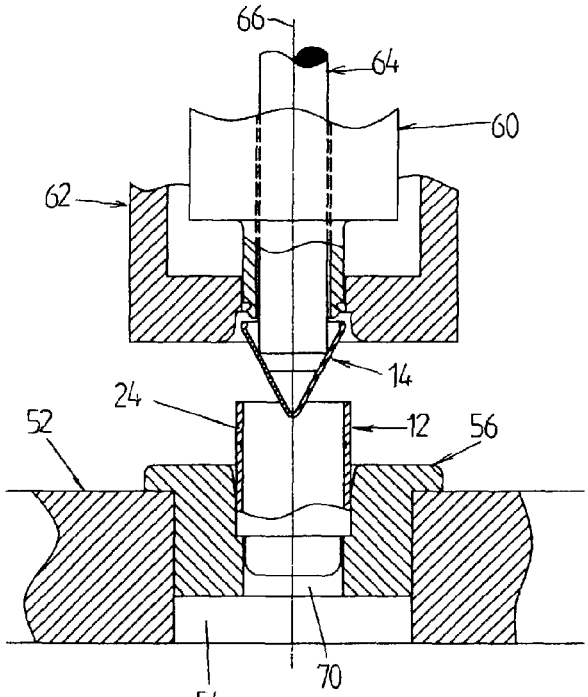
FIG. 10 is a view corresponding to FIGS. 2, 4, 6 and 8 during a fourth step of the removal process.
Figure 11:
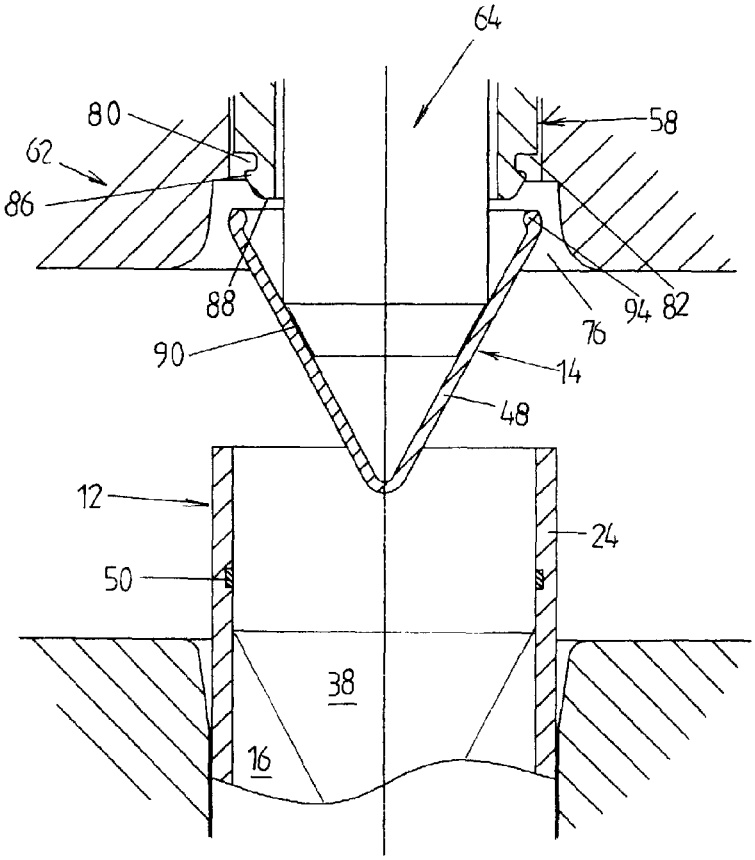
FIG. 11 is an enlarged detailed view of a central portion of FIG. 10.

In a fourth step of the process as shown in FIGS. 10 and 11 the punch 60 with the extraction tool 58 and the alignment tool 62 are moved further upwardly into their upper end position that corresponds to their upper end position in FIGS. 2 and 3. The ejection tool 64 is kept stationary so that the upper or inner surface of the conical portion 48 of the metal cone 14 will hit the taper 90 at the bottom end of the ejection tool 64 before the punch 60 with the extraction tool 58 and the alignment tool 62 reach their upper end position. This will stop the upward movement of the cone 14 while the extraction tool 58 is moved further upwardly. Due to this the deformed upper end portion 94 of the rim 46 is disengaged from the form fit engagement with the groove 80. The vertical position of the bottom end of the ejection tool 64 is such that the tip of the metal cone 14 has not yet been withdrawn from the tubular housing portion 24 when the upper end portion 94 of the rim 46 is disengaged from the groove 80. Therefore the cone 14 will fall back onto the top end of the tubular housing portion 24, as best shown in FIG. 12.

Figure 12:
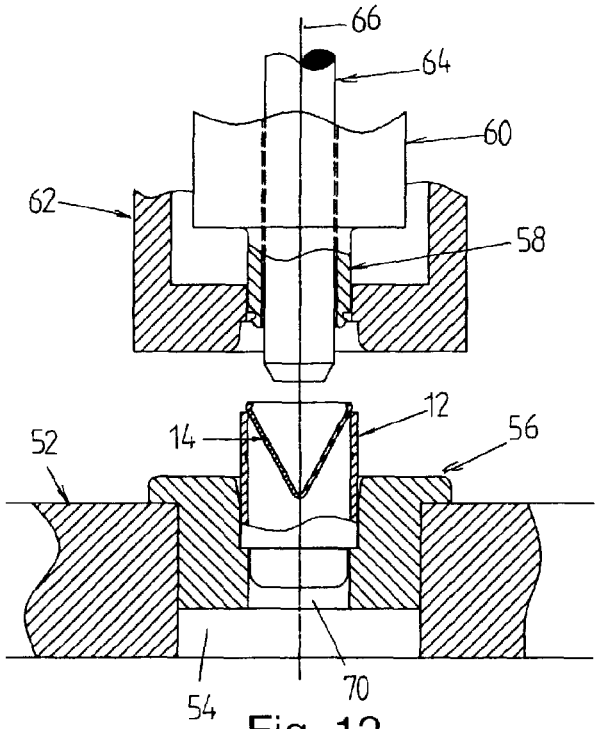
FIG. 12 is a view corresponding to FIGS. 2, 4, 6, 8 and 10 at the end of the removal process.
Figure 13:
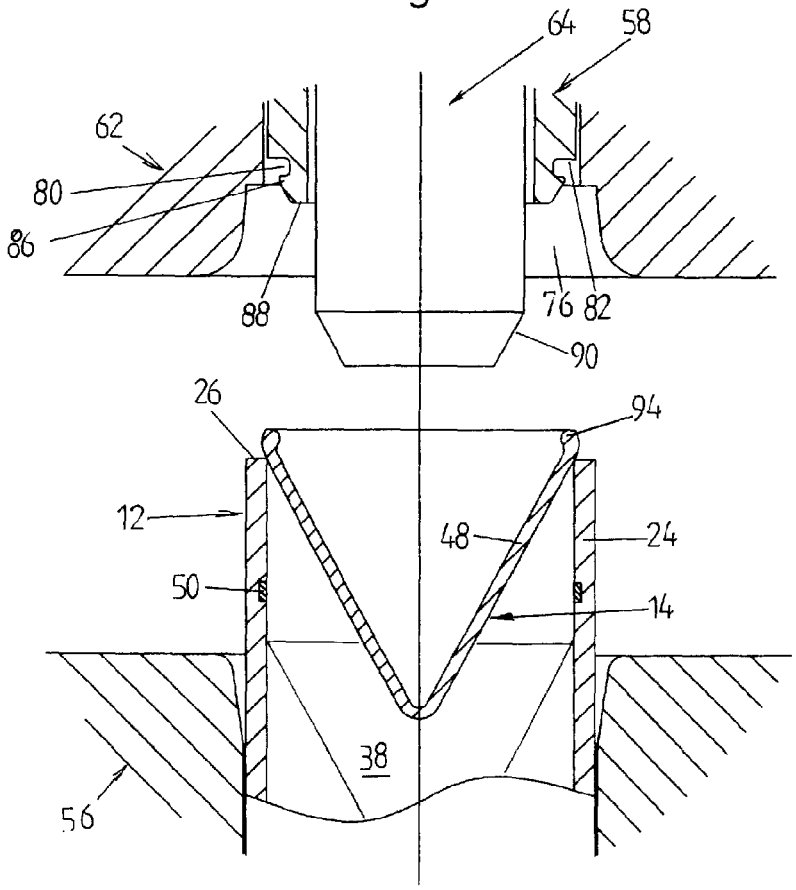
FIG. 13 is an enlarged detailed view of a central portion of FIG. 12.

In the end position of the process as shown in FIGS. 12 and 13 the punch 60 with the extraction tool 58 and the alignment tool 62 have reached again their upper end position. The cone 14 is loosely supported on the housing 12 with the base of the cone 14 resting on the upper end of the tubular housing portion 24 and the tip of the cone 14 being within the tubular housing portion 24. In this position the support 52 with the holder 56, the dismantled shell 10 and the metal cone 14 can be moved to the next station in the plant for burning the explosive charge 16 within the housing 12 and adhering to the cone 14.

Although certain embodiments have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. Method for the delaboration of ammunition, the ammunition including a housing with a tubular housing portion made of steel and open at one end, a cone made of ductile metal and fitted into the tubular housing portion, the cone having a base with a tubular rim, and an explosive charge contained between the housing and the cone, the method comprising the following steps:

a) inserting an extraction tool through the open end into the tubular housing portion for extracting the cone through the open end, b) axially compressing the tubular rim of the cone between the extraction tool and the explosive, c) deforming a portion of the tubular rim into a form fit with the extraction tool, d) withdrawing the extraction tool from the housing portion, and e) at least partially withdrawing the cone from the housing portion together with the extraction tool.

2. Method according to claim 1, further comprising a preceding step of aligning the tubular housing portion with respect to the extraction tool.

3. Method according to claim 2, wherein the step of aligning the tubular housing portion with respect to the extraction tool comprises engaging the tubular housing portion with a recess of an alignment tool that surrounds the extraction tool.

4. Method according to claim 1, wherein step b) comprises: compressing the tubular rim of the cone with a blunt annular face of the extraction tool.

5. Method according to claim 1, wherein step c) comprises: deforming an upper end portion of the tubular rim radially inwardly into a circumferential groove of the extraction tool.

6. Method according to claim 5, wherein the amount of deformation and expansion of the upper end portion of the tubular rim into the circumferential groove is such that the axial forces required to remove the deformed upper end portion from the circumferential groove exceed the frictional forces required to withdraw the metal cone from the tubular housing portion.

7. Method according to claim 1, wherein step b) comprises: shearing off an external portion of the tubular rim of the metal cone that is in engagement with an inner circumferential groove of the tubular housing portion.

8. Method according to claim 1, further comprising the step of removing or separating the metal cone from the extraction tool after the step of withdrawing the extraction tool from the tubular housing portion.

9. Method according to claim 8, wherein the extraction tool is moved upwardly during the step of withdrawing the extraction tool from the tubular housing and wherein the metal cone is removed from the extraction tool while a tip of the metal cone is still within the tubular housing portion so that the metal cone will partially fall back into tubular housing portion after the removal from the extraction tool.

10. Method according to claim 1, wherein the step of removing the metal cone from the extraction tool comprises the step of eliminating the form fit of the deformed tubular rim with the extraction tool by pushing an ejecting tool against an inner surface of the metal cone.

11. Method according to claim 1, comprising a further step f) of burning any explosive adhering to the tubular housing and the metal cone after step e).

12. Method according to claim 1, comprising a further step of removing a detonator from the ammunition before step a).

13. Apparatus for the delaboration of ammunition, the ammunition comprising a housing with a tubular housing portion that is open at one end, a metal cone fitted into the tubular housing portion, the metal cone having a base with a tubular rim, and an explosive contained between the housing and the metal cone, the apparatus comprising:

at least one seat for receiving the ammunition and for holding the ammunition in a position, where the open end of the housing portion faces away from the seat;

an extraction tool, means for pressing the extraction tool into the housing portion, wherein the extraction tool comprises a blunt annular compression face for engagement with an end face of the tubular rim of the cone and further comprises a circumferential groove for receiving a portion of the compressed and deformed tubular rim in a form fit engagement.

14. Apparatus according to claim 13, further comprising an alignment tool for aligning the tubular housing portion with respect to the extraction tool.

15. Apparatus according to claim 14, wherein the alignment tool surrounds the extraction tool and wherein the alignment tool is axially movable with respect to the seat and the extraction tool.

16. Apparatus according to claim 15, wherein the alignment tool has a recess for receiving an upper end of the tubular housing portion.

17. Apparatus according to claim 13, further comprising an ejecting tool within an inner bore of the extraction tool the ejecting tool and the extraction tool being axially movable relative to each other.

18. Apparatus according to claim 13, wherein an angle of inclination of the blunt annular compression face with respect to a movement axis of the extraction tool exceeds 60 degrees.

19. Apparatus according to claim 13, wherein the blunt annular compression face has an outer diameter which is slightly less than an inner diameter of the tubular housing portion.

20. Apparatus according to claim 13, wherein the blunt annular compression face has a sharp outer edge.

21. Apparatus according to claim 13, wherein the circumferential groove is disposed radially inwardly from the blunt annular compression face.

* * * * *